US005880396A

United States Patent [19]

Zacharias

[11] Patent Number: 5,880,396

[45] Date of Patent: Mar. 9, 1999

[54] PROCESS FOR GUIDING A FLYING OBJECT AND FLYING OBJECTS

[76] Inventor: Athanassios Zacharias, Grossgmainer Strasse 28, D-8232 Bayerisch Gmain, Germany

[21] Appl. No.: 63,507

[22] Filed: Mar. 26, 1993

[30] Foreign Application Priority Data

Mar. 27, 1992 [DE] Germany ..... 42 10 113.1

[51] Int. Cl.[6] ..... F42B 10/66

[52] U.S. Cl. ..... 102/384; 102/387; 102/489; 239/265.27; 244/52; 244/3.22

[58] Field of Search ..... 102/374, 384, 102/387, 476, 489; 244/3.21, 3.22, 52; 60/228, 229; 239/265.25, 265.27

[56] References Cited

U.S. PATENT DOCUMENTS

| | | | |
|---|---|---|---|
| 2,974,594 | 3/1961 | Boehm | 60/229 |
| 3,072,055 | 1/1963 | Ross | 102/476 |
| 3,196,794 | 7/1965 | Meade | 244/3.21 |
| 3,276,376 | 10/1966 | Cubbison et al. | 244/3.21 |
| 3,398,916 | 8/1968 | Van Vyve | 102/476 |
| 3,612,442 | 10/1971 | Chisel | 244/3.22 |
| 4,211,378 | 7/1980 | Crepin | 244/3.22 |
| 4,568,040 | 2/1986 | Metz | 244/3.22 |
| 4,674,408 | 6/1987 | Stessen | 102/384 |
| 4,711,178 | 12/1987 | Argyrakis | 102/384 |
| 5,189,248 | 2/1993 | Deffayet et al. | 102/374 |

FOREIGN PATENT DOCUMENTS

| | | | |
|---|---|---|---|
| 2 002 885 | 2/1979 | United Kingdom . | |
| 2149066 | 6/1985 | United Kingdom | 102/476 |

*Primary Examiner*—Harold J. Tudor
*Attorney, Agent, or Firm*—Burns, Doane, Swecker & Mathis, L.L.P.

[57] ABSTRACT

Process for guiding an elongated missile, equipped with booster motor, sustainer, power source, control electronics, payload, and search head, from above, upon a target, such as a helicopter, where the missile, after ballistic flight, is braked before the target area by a drogue chute and is diverted into a position that is essentially perpendicular to the earth's surface over the target area so that the search head of the missile, which is suspended from the drogue chute, will be pointed downward, whereupon, after the search head has locked on the target, the drogue chute is separated and the missile is guided to the target by the sustainer, characterized in that, immediately prior to, before, or after the moment of drogue chute deployment, a lateral motor, located in the center of gravity of the missile, is turned on so that, first of all, in order to accelerate the tilt-off of the missile into the vertical, there is generated a force that is added vectorially to the force of gravity and that thereupon one can counteract the missile's rolling, pitching, and yawing motions, that take place during the search phase that follows the tilt-off, so that the missile is stabilized, as well as missile for performance of said process.

7 Claims, 7 Drawing Sheets

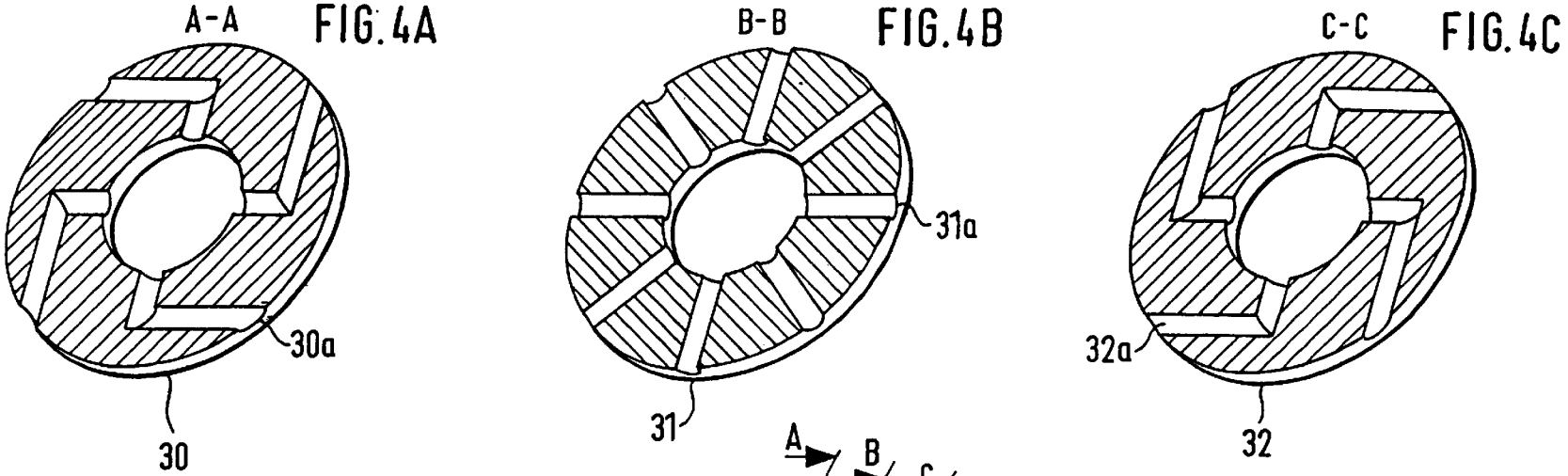
FIG. 4C
FIG. 4B
FIG. 4A
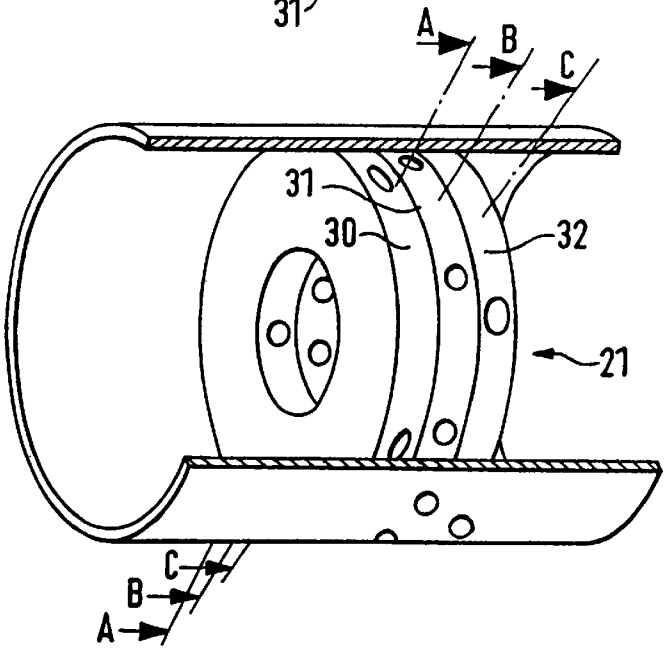
FIG. 4

PROCESS FOR GUIDING A FLYING OBJECT AND FLYING OBJECTS

This invention relates to a process for guiding an elongated mossile, equipped with booster motor, cruise engine, power source, control electronics, warhead, and search head, from above, upon a target, such as a helicopter, where the missile, after ballistic flight, is braked by a drogue chute before it arrives at the target area and is diverted into a position that is essentially perpendicular to the Earth's surface, over the target area, so that the search head of the missile, suspended from the drogue chute, is pointed downward, whereupon—after the search head is locked on the target—the drogue chute is separated and the missle is guided to the target sustainer [cruise engine].

Projectiles that can be fired from a launch tube and missiles equipped with booster motor are known; they are known, for example, from DE 35 16 673 A1 and DE 33 06 659 A1; above the target, they expel one or several active bodies that then fall down, upon the target that is on the ground, braked by a parachute. These projectiles or missiles, however; are useful only to engage moving targets, such as moving tanks or perhaps low-flying helicopters. It has therfore already been proposed that one develop missiles that, at the end of their ballistic flight path that is before the target area, be so diverted into the vertical that point, which is equipped with a search head, will point down upon the ground. A parachute, which is unfolded as the missile is deflected, will brake the free fall so that the honing head will have enough time to lock on the target. The moment the search head has acquired the target, the parachute is dropped and a sustainer, stowed in the missile, is ignited so that the missile, guided by the search head and driven by the sustainer, will start tracking the moving target in the known fashion. Difficulties, however, cropped up during the development of such a missile, particularly because the missile needs a comparatively long span of time for its deflection from the ballistic path, a deflection that is based on the force of gravity—and because the missile performs rolling motions and, because of the diversion, certain pitch and yaws motions, that considerably disturb the lock-on process of the search head.

The purpose of the invention at hand, therefore, is to provide a process with whose help it will be possible to divert a missile of the last-mentioned kind in the shortest time from its ballistic flight path into the vertical and, in the process, stabilize the missile with respect to polling, pitching, and yawing motions. It is furthermore the task of the invention to create a correspondingly designed missile.

According to the invention, as the missile reaches a point before the target area, a drogue chute is deployed that severely brakes the missile's forward speed, At the same time, a lateral motor exerts a force upon the missile that is added in a vectorial fashion to the force of gravity. As a result of both of these measures, the diversion of the missile from the ballistic flight path into the vertical takes place very quickly. The lateral motor—that can exert both radial and tangential forces upon the missile—here suppresses the missile's rolling, pitching, and yawing motions so that the missile's search head can seek the target out undisturbed and can lock upon the target.

The lateral shift of an ammunition item, by means of series-ignitable pulse transmitter, is known from DE-PS 34 27 227; it also provides an orientation parachute; however, the basic idea behind the invention—that is, to generate a tilting moment around a horizontal axis that runs through the deployed drogue chute by using the lateral motor—cannot be gleaned from this publication. Something similar applies to DE-PS 28 30 859; here, according to column 3, lines 18 ff., the solid pulse transmitters are to work in such a manner that the missile will be rotated around the center of gravitation G quite in contrast to the invention, where the lateral motor is intended to bring about a tilting action around the axis running through the drogue chute.

The drawings illustrates one version of the missile according to the invention.

FIG. 4 shows the essential parts of a lateral motor of the missile in a perspective view;

Figure 5:
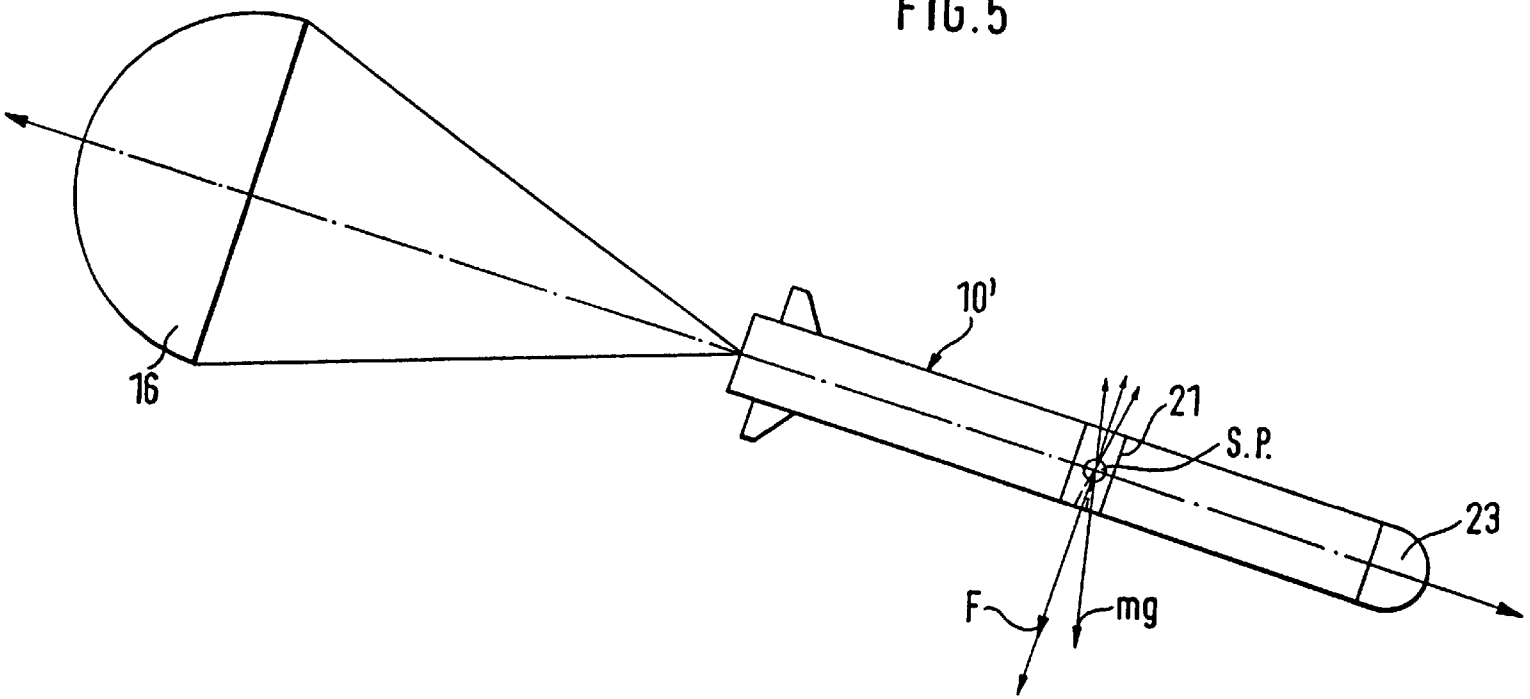

FIG. 4*a*, 4*b* and 4*c* illustrate the essential parts of the lateral motor shown in FIG. 4, in an individual presentation;

FIG. 5 is a sketch to explain the tipping process of the missile; and

Figure 5A:
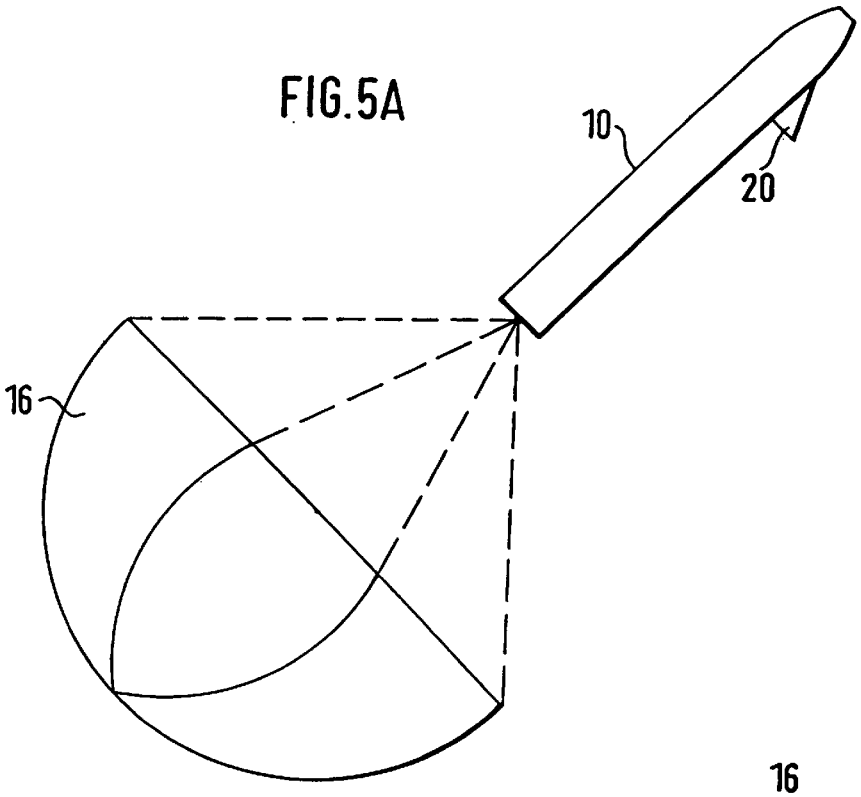
Figure 5B:
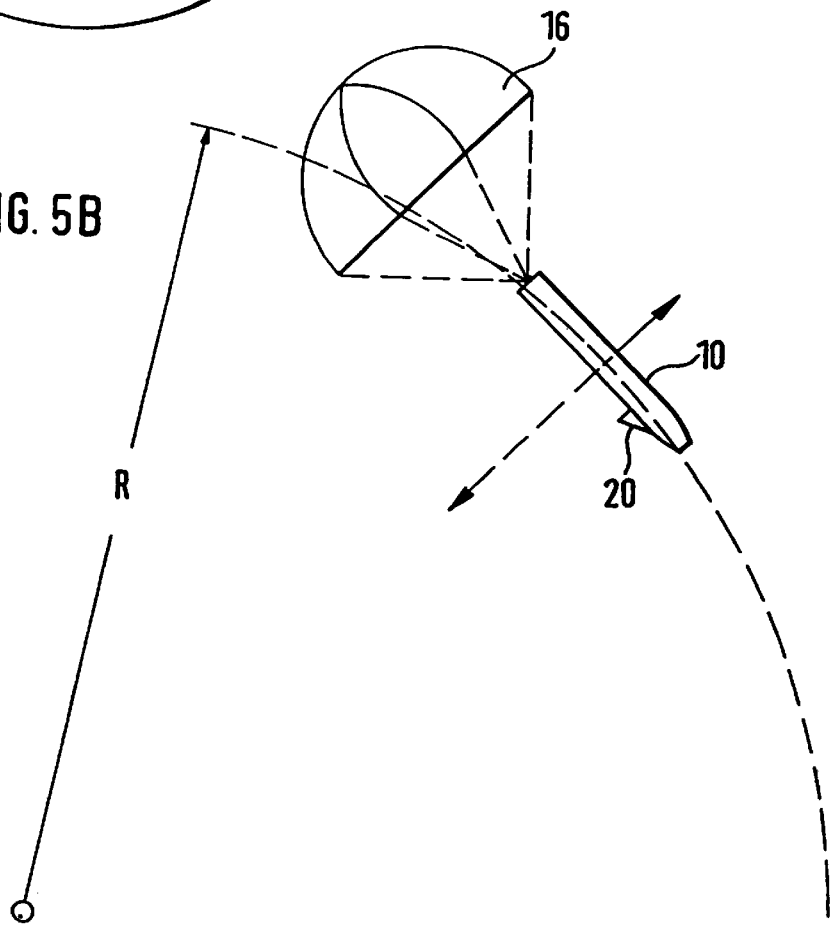
Figure 6:
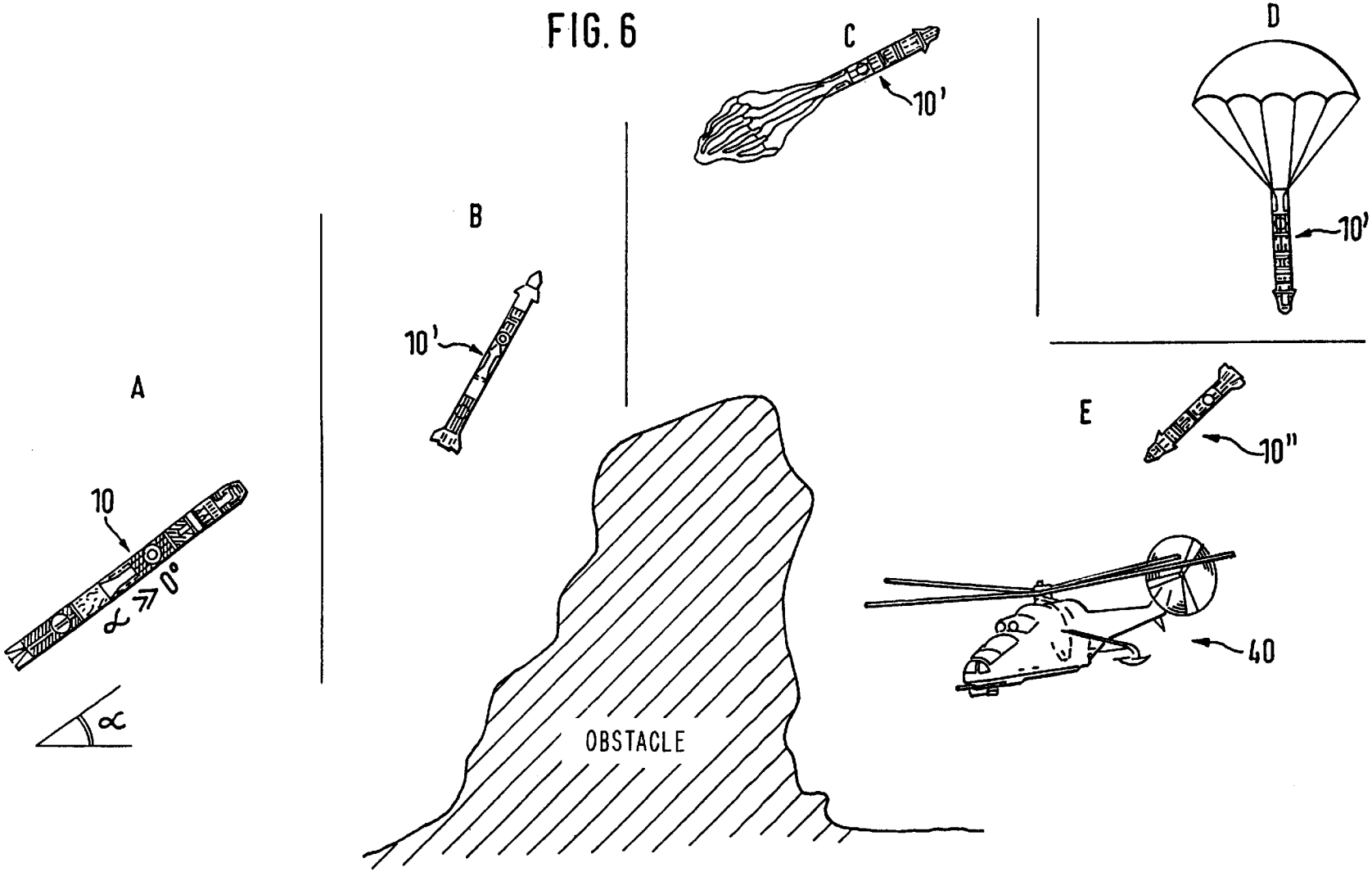

FIG. 5A shows the missile with the drogue chute and a canard that has been extended and folded out;

FIG. 5B is a sketch to explain the tilting process of the missile with a canard that has been folded out;

FIG. 6 is a sketch to explain the entire process from missile launch until the missile tracks the target.

Figure 1:
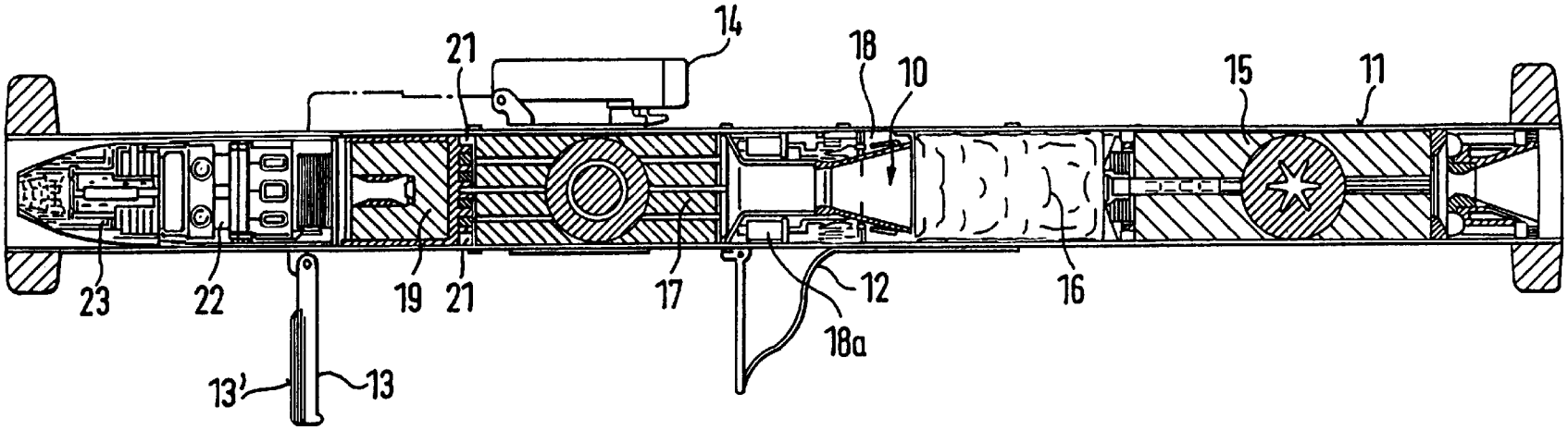
FIG. 1 is a longitudinal profile through the missile before launch.

According to FIG. 1, the missile, which is labeled 10 as a whole, is located in a launch tube 11 that is provided with a shoulder holder 12, a holder 13 with trigger 13' and sight optics 14. Missile 10 has a booster motor 15, a folded drogue chute 16, a sustainer 17, an extensible rudder 18, a payload 19, an extensible forward rudder (canard fins) 20, a lateral motor 21, control electronics 22 with microprocessor, regulator and battery, as well as search head 23.

Figure 2:
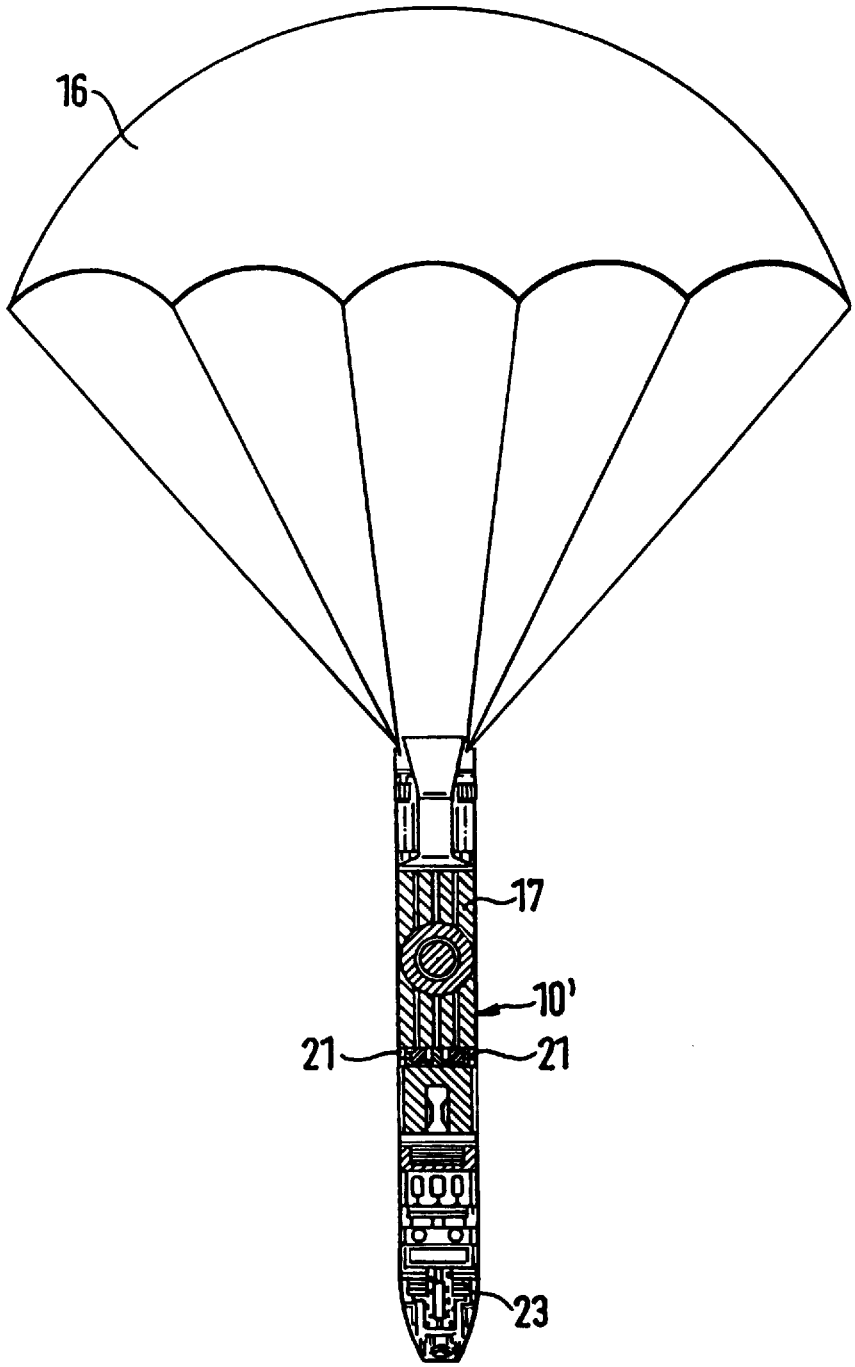
FIG. 2 is a longitudinal profile through the missile suspended from the drogue chute.
Figure 3:
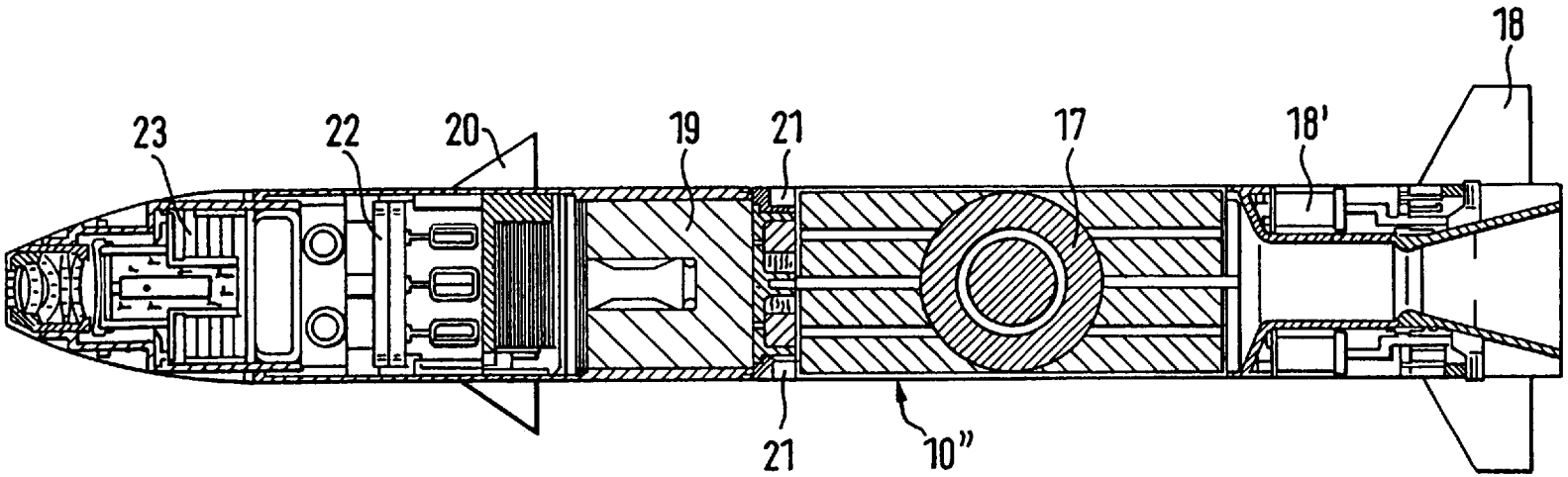
FIG. 3 is a longitudinal profile through the missile after the drogue chute has been jettisoned.

After missile 10 has been launched from launch tube 11 and after the booster motor 15 has burned off, the latter is jettisoned. The remaining missile is illustrated in FIG. 2 and is labeled 10', specially suspended on the drogue chute 16 which has been deployed in the meantime. Search head 23, housed in the tip of the missile, here points vertically downward, in other words, toward the earth's surface. FIG. 3 shows the missile that is left after the drogue chute 16 has been jettisoned and that is now labeled 10"; rudder 18 is extended by rudder motor 18'; forward rudder 20 is also run out.

FIG. 4 shows the lateral motor 21. This motor 21 consists of 3 disk bodies 30, 31, 32; disk body 30 reveals engine nozzles 30*a* that emerge tangentially in a counterclockwise fashion, middle disk body 31 reveals engine nozzles 31*a* that emerge radially and disk body 32 reveals engine nozzles 32*a* that emerge tangentially in a clockwise direction. The 3 disk bodies 30, 31, and 32 can be supplied separately with pressurized drive gas; the middle disk body 31, moreover, can be supplied in a separate fashion with respect to its individual nozzles 31*a* or with respect to nozzle sectors. It will be readily understood that, when a pressurized gas escapes from tangential nozzles 30*a* and 32*a*, a force is exerted upon the missile that runs in the direction of a rotation around its longitudinal access, specifically, counterclockwise or clockwise. On the other hand, if pressure gas is released from one of the nozzles 31*a* or from a nozzle sector of nozzles 31*a*, then a force is exerted upon the missile in a radial direction, specifically, opposite to the direction of the active nozzle 31*a* or the active nozzle sector. By suitably operating lateral motor 21, one can thus counteract both the rotary motions of the missile around its longitudinal axis (rolling motion around X-axis) as well as translation movements of the missile in a plane that runs perpendicularly to its longitudinal axis (pitch motions along the Y-axis, yaw motions along the Z-axis).

The essential thing now is that the lateral motor is at the center of gravity of the missile, specifically, at the center of gravity of missile 10', in other words, after booster motor 15 has been jettisoned. That makes it possible to accelerate the initially mentioned diversion of the missile, after completion of its ballistic flight, into the vertical in an optimum fashion, as this is indicated in FIG. 4. If missile 10' is braked by drogue chute 16 and if the upward-pointed radial nozzle 31*a* or the upward point corresponding nozzle sector goes into action, as indicated in FIG. 5, then, in addition to the force of gravity, mg, a force F attacks at the missile's center of gravity, S.P. and that force F is added in a vectorial fashion to the force of gravity; as a result, the diversion of missile 10' from the essentially horizontal around the center of drogue chute 16 into the vertical is speeded up considerably and the duration of the diversion process is thus considerably shortened.

That, however, can be done also in a different way: one or two fins (canards) are folded out on one side (FIG. 5A). The rolling moment, generated by the weight of the fin around the center of gravity turns the terminal guidance stage so that the fin will first point down (toward the earth's surface), although always in the direction toward the center of the path curvature (FIG. 5B).

If one now turns on only one lateral motor nozzle of the radial motor on the side opposite to the fin, then the path diversion is accelerated accordingly.

We will now explain the entire flight of the missile with the help of FIG. 6 The gunner places the launch tube 11 on his shoulder and sights the target, for example, an enemy helicopter 40, by means of sight optics 14. Thereupon, using trigger 13' he fires the shot, that is to say, booster motor 13 is turned on and missile 20 leads launch tube 11 at an elevated angle $\alpha$ during the launch phase labeled A. After the booster motor has burned off and after it has been jettisoned, missile 10' winds up in the phase of its ballistic flight that is labeled B. As soon as missile 10' has reached the target area, as soon as it is over target 40 or immediately before that spot, phase C is triggered, that is to say, the braking and diversion process. Now drogue chute 16 is unfolded and, at the same time, as mentioned earlier, disk body 31 of lateral motor 21 is started up so that the missile will tilt off and will get into its phase of descent and target identification that is labelled D. During this phase D, missile 10', which is descending while suspended from drogue chute 16, is stabilized by the lateral motor 21, that is to say, tangential nozzles 30*a* and 32*a* suppress a row motion, while radial nozzles 31*a* suppress the pitch and yaw motions of the missile. As a result of this stabilization of missile 10', its search head 23 can perform a quick and exact target identification and can lock on target 40. That also starts up the sustainer 17 and drogue chute 16 is jettisoned and missile 10" now starts target tracking in phase E. Earlier, it was mentioned that the lateral motor 21 is turned on during phase C for the acceleration of the tilt-off process and, in phase D, for stabilization; it must now be pointed out that the lateral motor can also be started up already immediately before reaching phase C; that is a good idea when missile 10' is already performing a rolling motion (rotation around its longitudinal access) during its ballistic phase B; this rolling motion is then suppressed already before the drogue chute 16 is unfolded and that is accomplished by tangential nozzles 30*a*, 32*a*.

The moment of deployment and separation of drogue chute 16, as well as the moment and manner of activation of lateral motor 21, are determined by the control electronics 22 whose microprocessor performs a tie-in and analysis of values that are supplied to it from a memory in which typical equipment values are stored, from position sensors that determine the position and location movements of the missile, from sight optics 14, and from search head 23. Of course, the control electronics also performs its usual tasks, such as triggering the sustainer and steering missile 10" to the target 40. Lateral motor 21 may be operated by compressed air although a pyrotechnical drive would be preferred for reasons of available space.

I claim:

1. Process for guiding an elongated missile, equipped with booster motor, sustainer, power source, control electronics, payload, and search head, from above upon a moving target, wherein the booster motor is released and the such defined remaining missile after ballistic flight is braked before the target area by a drogue chute and is deverted into a position that is essentially perpendicular to the earth's surface over the target area so that the search head of the missile, suspended from the drogue chute, will be pointed downward, whereafter after the search head has locked on the target, the drogue chute is separated and the missile is guided to the target by the sustainer, characterized in that immediately about the moment of drogue chute deployment, with the remaining missile still being suspended from the drogue chute, a lateral motor producing both radial and tangential forces, arranged in the center of gravity of the remaining missile, is turned on so that first in order to accelerate the tilt-off of the missile into the vertical, a downwardly directed radial force is generated that is added vectorially to the force of gravity and creates a momentum having the tendency of turning the remaining missile around the center of the drogue chute into the vertical, whereafter a combination of tangential and/or radial forces is created to counteract the remaining missile's rolling, pitching, and yawing motions taking place during the search phase that follows the tilt-off and before the drogue chute separation so that the missile is thus stabilized.

2. Process according to claim 1, where to suppress rolling motions appearing during the missile's ballistic flight, the lateral motor is started up immediately before the moment at which the drogue chute is unfolded.

3. Process according to claim 1 or 2, wherein the lateral motor is operated by compressed air.

4. Process according to claim 1 or 2, wherein the lateral motor is operated pyrotechnically.

5. Missile being guided from above upon a moving target, comprising a booster motor at its after end, a search head at its front end, a folded drogue chute located in a section of the missile between the booster motor and the search head, a sustainer located in a section of the missile between the folded drogue chute and the search head, where the booster motor is released and the remaining missile after ballistic flight is braked before the target by the drogue chute and is diverted into a position that is essentially perpendicular to the earth's surface over the target so that the search head of the missile, suspended from the drogue chute, will be pointed downward, and wherein after the search head is locked on the target, the drogue chute is separated and the missile is guided to the target by the sustainer, a lateral motor at about the moment of drogue chute deployment, with a remaining missile still being suspended from the drogue chute, creates both tangential and radial forces at the remaining missile's center of gravity, with radial and tangential motor nozzles accelerate tilt-off of the missile into a vertical and a downwardly directed radial force is generated and added vectorially to the force of gravity in creating a momentum having the tendency of turning the remaining missile around the center of the drogue chute into the vertical, and creates a combination of tangential and radial forces to counteract the remaining missile's rolling, pitching, and yawing motions taking place during the search phase that follows tilt-off and before the drogue chute separation such that the missile is thereby stabilized, a payload located behind the search head, and control electronics with microprocessor and location sensors guide the missile to the moving target.

6. Missile according to claim 5, where the lateral motor consists of three disk bodies, with one disk reveling radial motor nozzles while the other two disk bodies reveal mutually opposite tangential motor nozzles.

7. Missile according to claim 5 or 6, characterized by a controllable canard fin assembly.

* * * * *